US009834238B2

(12) United States Patent
Harasaki

(10) Patent No.: US 9,834,238 B2
(45) Date of Patent: Dec. 5, 2017

(54) TRANSPORTING VEHICLE SYSTEM, AND METHOD OF CONTROLLING TRANSPORTING VEHICLE

(71) Applicant: MURATA MACHINERY, LTD., Kyoto-shi, Kyoto (JP)

(72) Inventor: Kazumi Harasaki, Inuyama (JP)

(73) Assignee: MURATA MACHINERY, LTD., Kyoto (JP)

( * ) Notice: Subject to any disclaimer, the term of this patent is extended or adjusted under 35 U.S.C. 154(b) by 0 days.

(21) Appl. No.: 15/127,045

(22) PCT Filed: Apr. 17, 2015

(86) PCT No.: PCT/JP2015/061877
§ 371 (c)(1),
(2) Date: Sep. 19, 2016

(87) PCT Pub. No.: WO2015/186440
PCT Pub. Date: Dec. 10, 2015

(65) Prior Publication Data

US 2017/0144681 A1 May 25, 2017

(30) Foreign Application Priority Data

Jun. 2, 2014 (JP) ..... 2014-114090

(51) Int. Cl.
*G05D 1/00* (2006.01)
*B61L 27/00* (2006.01)
*B61L 17/00* (2006.01)

(52) U.S. Cl.
CPC ..... *B61L 27/0027* (2013.01); *B61L 17/00* (2013.01)

(58) Field of Classification Search
CPC ..... B61L 27/0027; B61L 17/00
USPC ..... 701/19
See application file for complete search history.

(56) References Cited

U.S. PATENT DOCUMENTS 6,285,951 B1 * 9/2001 Gaskins ..... G05D 1/0217 340/992
8,527,088 B2 * 9/2013 Tominaga ..... H01L 21/67769 414/562
2010/0228389 A1 * 9/2010 Hayashi ..... G05D 1/0297 700/229
2011/0178657 A1 * 7/2011 Harasaki ..... G05D 1/0272 701/2
2012/0004767 A1 * 1/2012 Tominaga ..... H01L 21/67769 700/230
2013/0321110 A1 * 12/2013 Clines ..... H01F 7/0247 335/220

FOREIGN PATENT DOCUMENTS

JP 11-085280 A 3/1999

* cited by examiner

*Primary Examiner* — Muhammad Shafi
(74) *Attorney, Agent, or Firm* — Keating & Bennett, LLP

(57) ABSTRACT

A transporting vehicle system includes a prohibited travel zone setter that sets a first prohibited travel zone where entry of a travelling vehicle is prohibited, an additional prohibited travel zone setter that sets a second prohibited travel zone upstream of the first prohibited travel zone according to rules, and a transporting vehicle controller that controls a transporting vehicle to prevent the vehicle from entering the first prohibited travel zone or the second prohibited travel zone.

5 Claims, 8 Drawing Sheets

TRANSPORTING VEHICLE SYSTEM, AND METHOD OF CONTROLLING TRANSPORTING VEHICLE

BACKGROUND OF THE INVENTION

1. Field of the Invention

The present invention relates to a transporting vehicle system that causes a transporting vehicle to travel along a predetermined travelling route, and a method of controlling the transporting vehicle.

2. Description of the Related Art

There is a transporting vehicle system for causing an unmanned transporting vehicle to automatically travel under a computer control along a travelling route that includes a plurality of one-way circulating routes preinstalled on, for example, a ceiling or a floor. In such a transporting vehicle system, for example, when a fault occurs in the transporting vehicle, other transporting vehicles are not able to travel in a certain zone of the travelling route including the position where the transporting vehicle is stopped. Additionally, when a track forming the travelling route is under construction, or the like, the transporting vehicle is unable to travel in a certain zone of the travelling route that is under construction.

Thus, if a situation occurs where there is a position that the transporting vehicle cannot travel, the conventional transporting vehicle system sets a certain zone of the travelling route including the aforementioned position as a prohibited travel zone. When selecting a route to the prescribed station, the transporting vehicle system selects such a route that the transporting vehicle does not travel the prohibited travel zone. (Refer to Japanese Unexamined Patent Application Publication No. 11-85280, for example.)

However, the prohibited travel zone could have been set on the downstream side of the prescribed station. If there is no branch point between the prescribed station and the prohibited travel zone, the transporting vehicle has nowhere to go resulting in the transporting vehicle being unable to travel after the transporting vehicle arrives at the prescribed station. In this regard, if the number of transporting vehicles getting caught in a so-called dead end increases, the transporting efficiency of the entire transporting vehicle system decreases.

SUMMARY OF THE INVENTION

Thus, preferred embodiments of the present invention provide a transporting vehicle system that reduces the number of transporting vehicles that become unable to travel and a method of controlling the transporting vehicle system.

A transporting vehicle system according to a preferred embodiment of the present invention is a transporting vehicle system including a plurality of transporting vehicles that travel along a route including node points that include branch points where the route branches off and merge points where the route merges into, and zones located between the node points; a first prohibited travel zone setter that sets a first prohibited travel zone that is one of the zones where entry of the transporting vehicles is prohibited; a second prohibited travel zone setter that sets a second prohibited travel zone upstream of the first prohibited travel zone according to rules; and a transporting vehicle controller that controls the transporting vehicles to prevent the transporting vehicles from entering the first prohibited travel zone or the second prohibited travel zone. The rules include a rule that, if one of the node points upstream of the first prohibited travel zone is one of the merge points, all of the zones that merge into the one of the merge points are set as additional prohibited travel zones; and a rule that, if one of the node points upstream of the first prohibited travel zone is one of the branch points and all of the zones branching off from the one of the branch points are the additional prohibited travel zones, one of the zones upstream of the one of the branch points is set as one of the additional prohibited travel zones.

A method of controlling a transporting vehicle according to a preferred embodiment of the present invention is a method of controlling a transporting vehicle system including transporting vehicles capable of traveling along a route including node points that include branch points where the route branches off and merge points where the route merges into, and zones located between the node points, the method including setting a first prohibited travel zone that is one of the zones where entry of the transporting vehicles is prohibited; setting a second prohibited travel zone upstream of the first prohibited travel zone according to rules; and controlling the transporting vehicles to prevent the transporting vehicles from entering the first prohibited travel zone or the second prohibited travel zone; wherein the rules include a rule that, if one of the node points upstream of the first prohibited travel zone is one of the merge points, all of the zones that merge into to the one of the merge points are set as additional prohibited travel zones; and a rule that, if one of the node points upstream of the first prohibited travel zone is one of the branch points and all of the zones branching off from the one of the branch points are the additional prohibited travel zones, the zone upstream of the one of the branch points is additionally set as one of the additional prohibited travel zones.

According to preferred embodiments of a transporting vehicle system and a method of controlling the transporting vehicle, for example, a zone in which the transporting vehicle that experienced a fault stops or a zone in which construction is underway is not only set as a prohibited travel zone, but a prohibited travel zone is additionally set according to rules including a rule that, if one of the node points upstream of the first prohibited travel zone is one of the merge points, all of the zones that merge into to the one of the merge points are set as additional prohibited travel zones, and a rule that, if one of the node points upstream of the first prohibited travel zone is one of the branch points and all of the zones branching off from the one of the branch points are the additional prohibited travel zones, the zone upstream of the one of the branch points is additionally set as one of the additional prohibited travel zones.

In a transporting vehicle system according to a preferred embodiment of the present invention, a transport vehicle is controlled to be prevented from entering the prohibited travel zone that has been set according to such rules, to avoid a situation in which only a prohibited travel zone is located downstream in the travel direction of the transporting vehicle, that is, a situation where the transporting vehicle gets caught in a dead end, has nowhere to go and thus is unable to travel. As a result, the number of transporting vehicles that become unable to travel is able to be significantly reduced.

Additionally, in a preferred embodiment of the present invention, each of the transporting vehicles includes a vehicle body controller that requests authorization for the transporting vehicle to enter one of the node points when the transporting vehicle reaches a front of the one of the node points. If the transporting vehicle controller authorizes one of the plurality of transporting vehicles, which requests authorized entry into the one of the node points, to enter the one of the node points, the transporting vehicle controller controls others of the plurality of transporting vehicles to prevent the others of the plurality of transporting vehicle from entering the one of the node points.

According to such a transporting vehicle system, it is possible to prevent two or more transporting vehicles from colliding with each other at the node point.

Additionally, in a preferred embodiment of the present invention, the transporting vehicle system may further include a fault determiner that determines a fault has occurred when the one of the plurality of transporting vehicles authorized by the transporting vehicle controller to enter the one of the node points does not reach the one of the node points within a predetermined time.

According to such a transporting vehicle system, it is possible to determine a fault in the transporting vehicle with a simple configuration without having to install a detection unit such as a sensor to detect a fault in the transporting vehicle.

Additionally, in a preferred embodiment of the present invention, if the fault determiner determines a fault in the one of the plurality of transporting vehicles authorized by the transporting vehicle controller to enter the one of the node points, the second prohibited travel zone setter sets one of the zones adjacent to the one of the node points as one of the additional prohibited travel zones.

According to such a transporting vehicle system, even if a fault occurs in the transporting vehicle that obtained authorization to enter a certain node point, it is possible to avoid a situation where other transporting vehicles are not able to enter the node point and have nowhere to go resulting in being unable to travel through.

Additionally, in a preferred embodiment of the present invention, the route may include a main route, and a first route, wherein the first route branches off from the main route at one of the branch points, the main route includes a first one of the merge points that merges with a second route downstream of the one of the branch points; and the first route merges into the main route at a second one of the merge points downstream of the first one of the merge points.

According to a transporting vehicle system with such a configuration, even if the authorized entry into the first merge point is provided to one of the transporting vehicles and then a fault occurs in the one of the transporting vehicles, other transporting vehicles are able to go back to the main route again from the second merge point by diverting past the first merge point. Thus, if a destination is located farther on the downstream side than the second merge point, an object to be transported is able to be transported without changing the destination.

According to various preferred embodiments of the present invention, the number of transporting vehicles that become unable to travel is significantly reduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described hereinafter with reference to the drawings. In the description of the drawings, the same reference signs are given to the same elements to omit duplicated explanation. The dimension ratio of the drawings does not always match each other.

Figure 1:
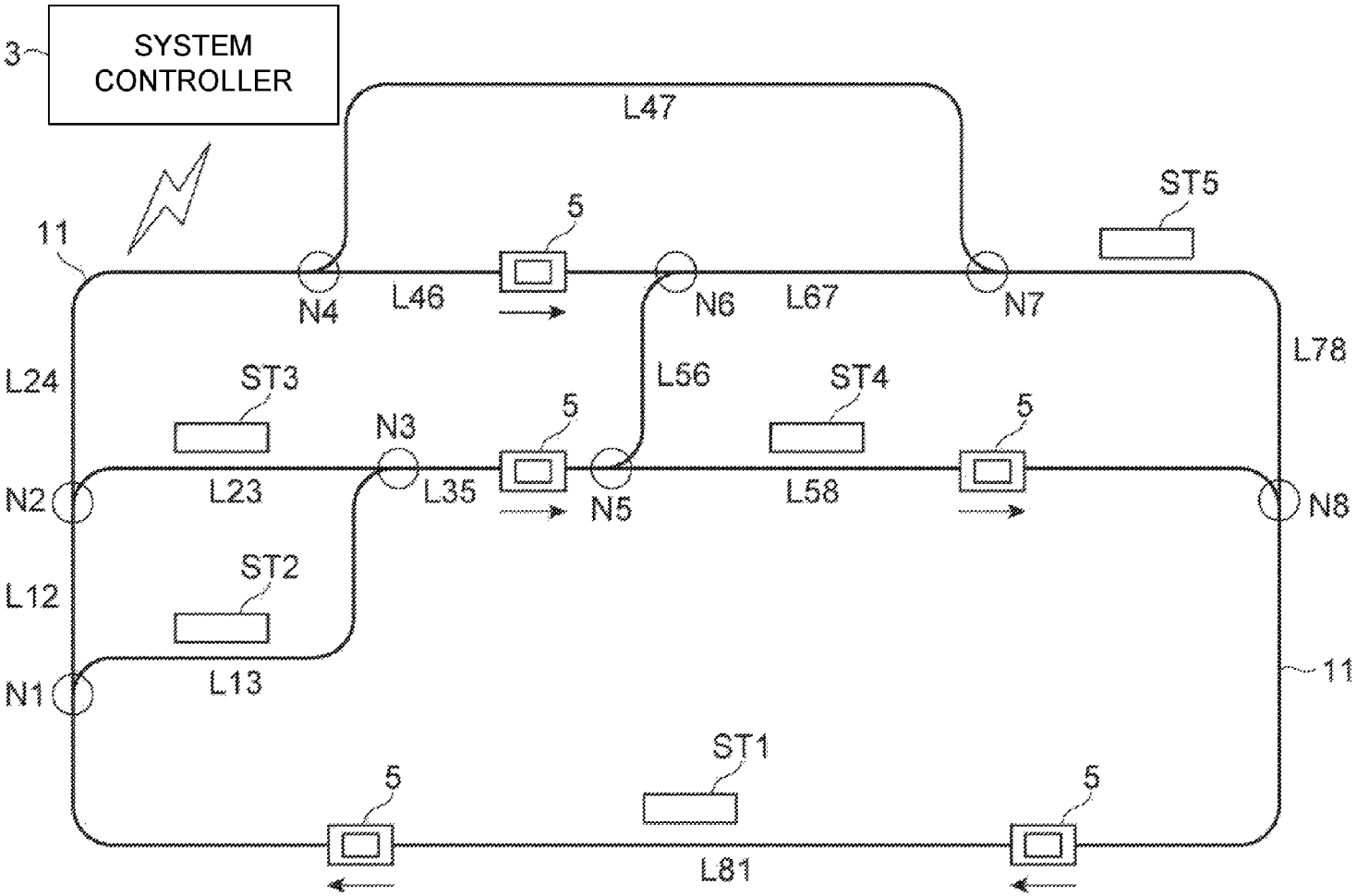
FIG. 1 is a configuration diagram illustrating a configuration of a transporting vehicle system according to a preferred embodiment of the present invention.

A transporting vehicle system 1 is a system for transporting an object to be transported by using an overhead travelling vehicle (transporting vehicle) 5 that is able to move along a track (travelling route). Here, for example, a description will be given by taking as an example the transporting vehicle system 1 in a factory or the like in which the overhead travelling vehicle 5 travels along a one-way track that is installed on a ceiling of the factory or the like. As shown in FIG. 1, the transporting vehicle system 1 mainly includes a track 11, a plurality of overhead travelling vehicles 5, and a system controller 3.

The track 11 is where the overhead travelling vehicle 5 travels along and is suspended from the ceiling, for example. As shown in FIG. 1, the track 11 on the transporting vehicle system 1 includes branch points (N1, N2, N4, N5) and merge points (N3, N6, N7, N8) which are node points, and zones between the node points (L12, L13, L23, L24, L35, L46, L47, L56, L58, L67, L78, L81). Along the track 11, stations which transfer the object to be transported (ST1, ST2, ST3, ST4, ST5) are positioned.

Figure 2:
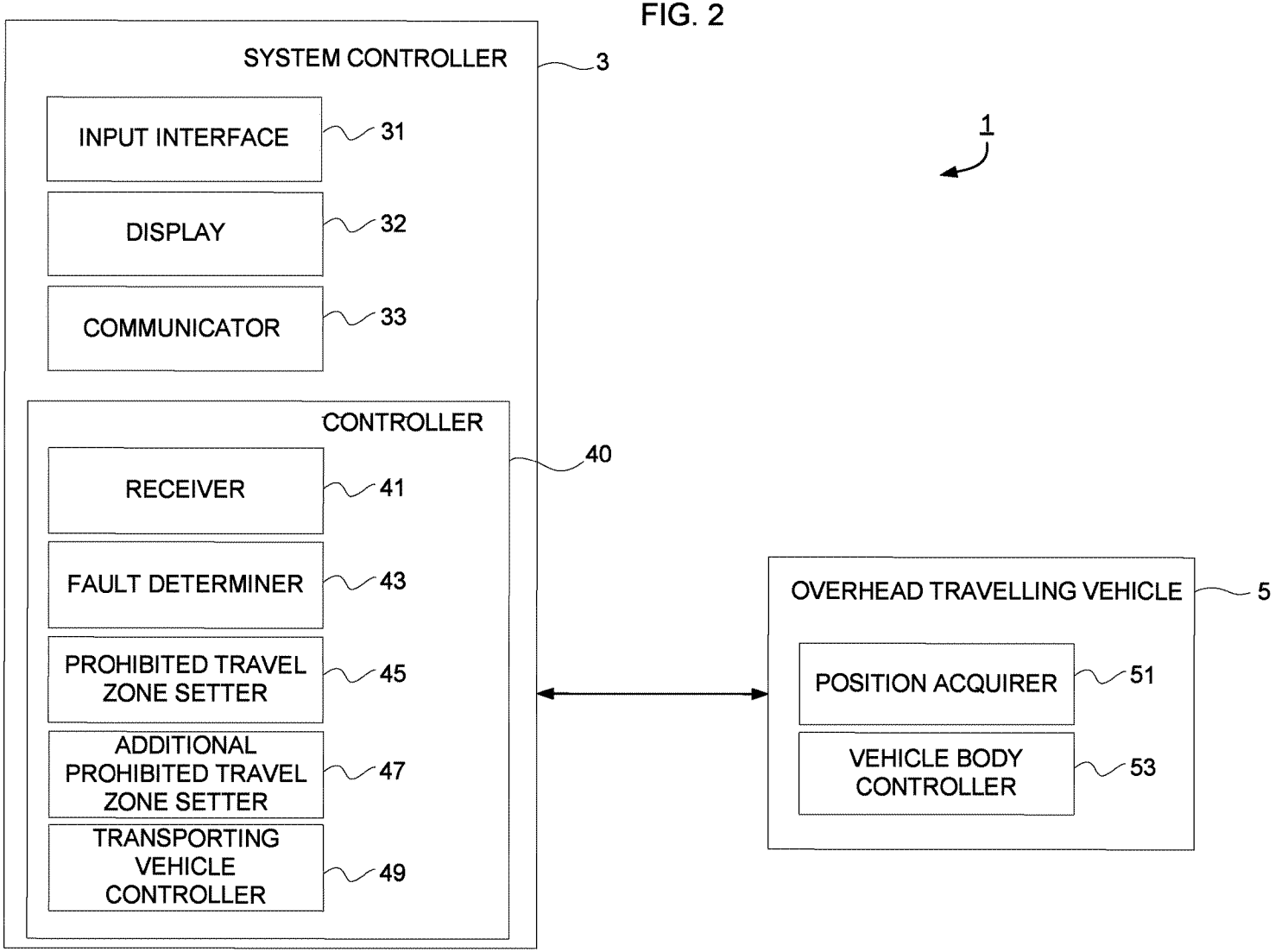
FIG. 2 is a functional block diagram illustrating a functional configuration of the transporting vehicle system of FIG. 1.

The overhead travelling vehicle 5 is able to transfer a general article which is an object to be transported. The object to be transported includes, for example, a semiconductor wafer, a glass substrate, and a general component. Apart from a mechanism to transfer the object to be transported, the overhead travelling vehicle 5 includes, as shown in FIG. 2, a position acquirer 51 and a vehicle body controller 53.

The position acquirer 51 acquires the position of the vehicle along the track 11. The position acquirer 51 may include, for example, a reader that reads a barcode or the like showing point information on the track 11 and an encoder. The position acquirer 51 sends the point information, which is acquired by the reader, and a travel distance after passing through the point, which is acquired by the encoder, as position data to the system controller 3.

The vehicle body controller 53 controls the travel of the overhead travelling vehicle 5, and is an electronic controller including, for example, a CPU (Central Processing Unit), a ROM (Read Only Memory) and a RAM (Random Access Memory). When the vehicle body controller 53 reaches the front of one of the node points, it requests a transporting vehicle controller 49 mentioned later for authorization to enter the node point. A so-called blocking control performed by the transporting vehicle controller 49 will be detailed later.

The system controller 3 controls the overhead travelling vehicle 5 (Step of controlling a transporting vehicle). The system controller 3, as shown in FIG. 2, includes an input interface 31, a display 32, a communicator 33 and a controller 40. The input interface 31 includes, for example, a keyboard and a mouse, and a user inputs various operations and various setting values. The display 32 includes, for example, a liquid crystal display, and displays various setting screens and also displays input screens or the like that are entered from, for example, the input interface 31.

The communicator 33 includes a processor that is configured or programmed to communicate with other devices or the like, and sends the overhead travelling vehicle 5 information on the station that the overhead travelling vehicle 5 should reach and information to control the vehicle body controller 53 and receives the present position of the overhead travelling vehicle 5 from the position acquirer 51 via a wireless communication network, for example. In addition, the communicator 33 receives a transport instruction including information of stations serving as a starting point and end point from a host controller, for example, via LAN (Local Area Network).

The controller 40 runs various control processes on the transporting vehicle system 1 (control methods of the transporting vehicle) which are detailed later, and includes, for example, a CPU, a ROM, a RAM and a hard disk. As shown in FIG. 2, the controller 40 is configured or programmed to include a receiver 41, a fault determiner 43, a prohibited travel zone setter 45, an additional prohibited travel zone setter 47, and a transporting vehicle controller 49 as conceptual elements or functional units that run various control processes on the transporting vehicle system 1. Such a conceptual element or functional unit may be configured as software where a program stored in the ROM is loaded on the RAM and then executed by a CPU. Furthermore, the controller 40 may be configured as hardware by an electronic circuit or the like.

The receiver 41 receives a prohibited travel zone that is a zone where entry of the overhead travelling vehicle 5 is prohibited. The receiver 41 receives the zone to be set as a prohibited travel zone via the input interface 31 in the system controller 3. For example, the receiver 41 receives an ID (identification) number of the zone that a user has inputted to the input interface 31.

The fault determiner 43 determines that when one of the overhead travelling vehicles 5, which has been authorized by the transporting vehicle controller 49 to enter one of the node points, does not reach the node point within the prescribed time, a fault has occurred in the overhead travelling vehicle 5. The fault determiner 43 outputs the information about the occurrence of a fault to the prohibited travel zone setter 45 when fault determiner 43 determines that a fault has occurred in the overhead travelling vehicles 5.

The prohibited travel zone setter 45 sets a prohibited travel zone that is a zone where entry of the overhead travelling vehicle 5 is prohibited (Step of setting a prohibited travel zone). The prohibited travel zone setter 45 sets the prohibited travel zone based on position information that is sent by the overhead travelling vehicle 5 determined by the fault determiner 43. Moreover, the prohibited travel zone setter 45 sets the prohibited travel zone based on information that the receiver 41 has received.

The additional prohibited travel zone setter 47 extracts a prohibited travel zone according to the following Rules 1 and 2 from the track 11 located on the upstream side of the zone that has been set as a prohibited travel zone, and automatically additionally sets the prohibited travel zone (Step of additionally setting a prohibited travel zone). Rules 1 and 2 are described hereinafter with reference to FIG. 3 to FIG. 5.

Rule 1: If a node point adjacent to the upstream side of the prohibited travel zone that has been set by the prohibited travel zone setter 45 is a merge point, all of the zones that merge into to the merge point are additionally set as prohibited travel zones.

Rule 2: If a node point adjacent to the upstream side of the prohibited travel zone that has been set by the prohibited travel zone setter 45 is a branch point and also all of the zones branching off from the branch point are prohibited travel zones, a zone on the upstream side adjacent to the branch point is additionally set as a prohibited travel zone.

Figure 3:
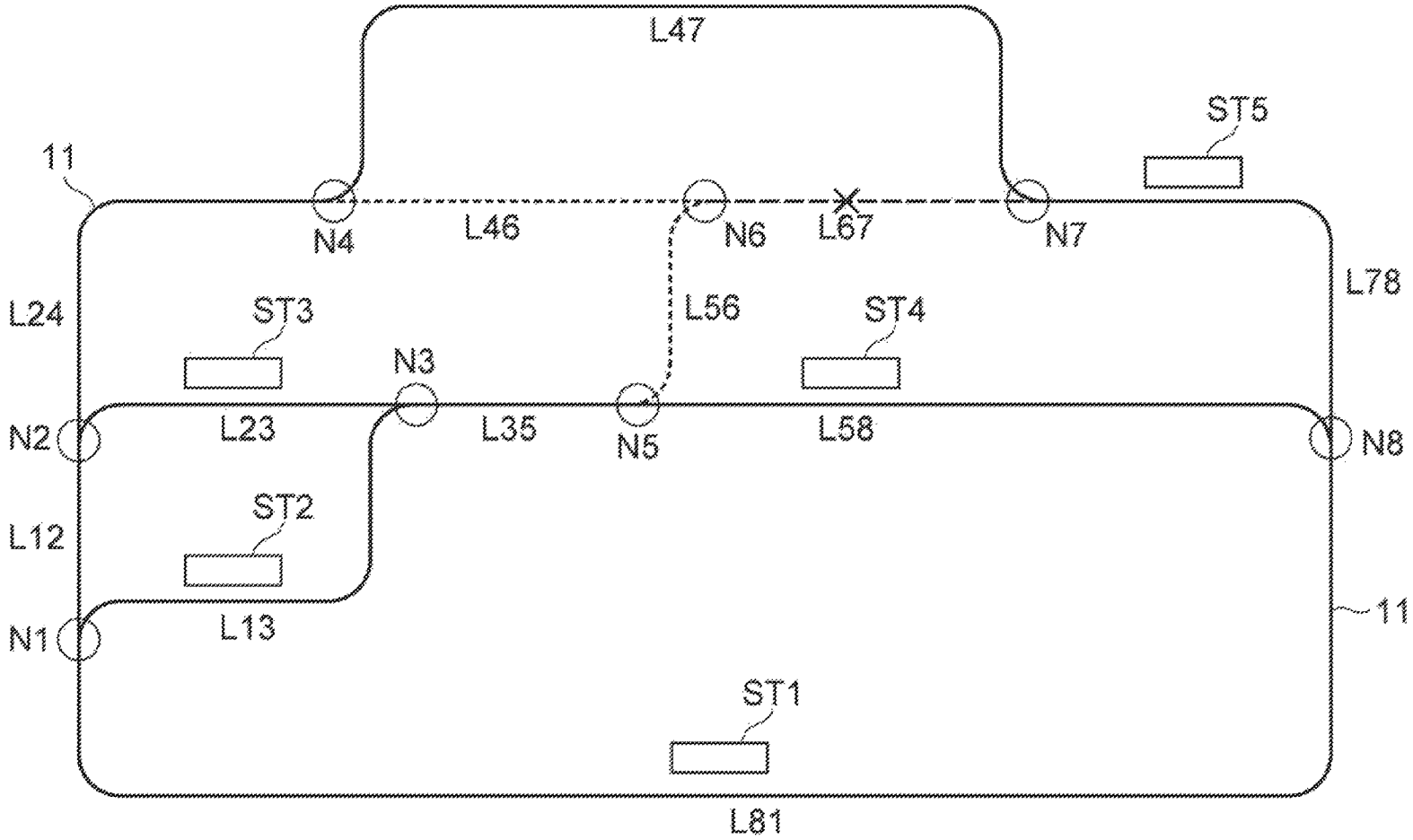
FIG. 3 is an explanatory diagram for describing an additional setting method of a prohibited travel zone according to a preferred embodiment of the present invention.

Rule 1 is specifically described with reference to FIG. 3. For example, as shown in FIG. 3, the zone L67 has been set as a prohibited travel zone by the prohibited travel zone setter 45. At that time, a node point adjacent to the upstream side of the zone L67 which has been set as a prohibited travel zone by the prohibited travel zone setter 45 is the merge point N6. In this case, Rule 1 is applied, and all of the zones that merge into the merge point N6 (zones L46 and L56) are additionally set as prohibited travel zones.

Figure 4:
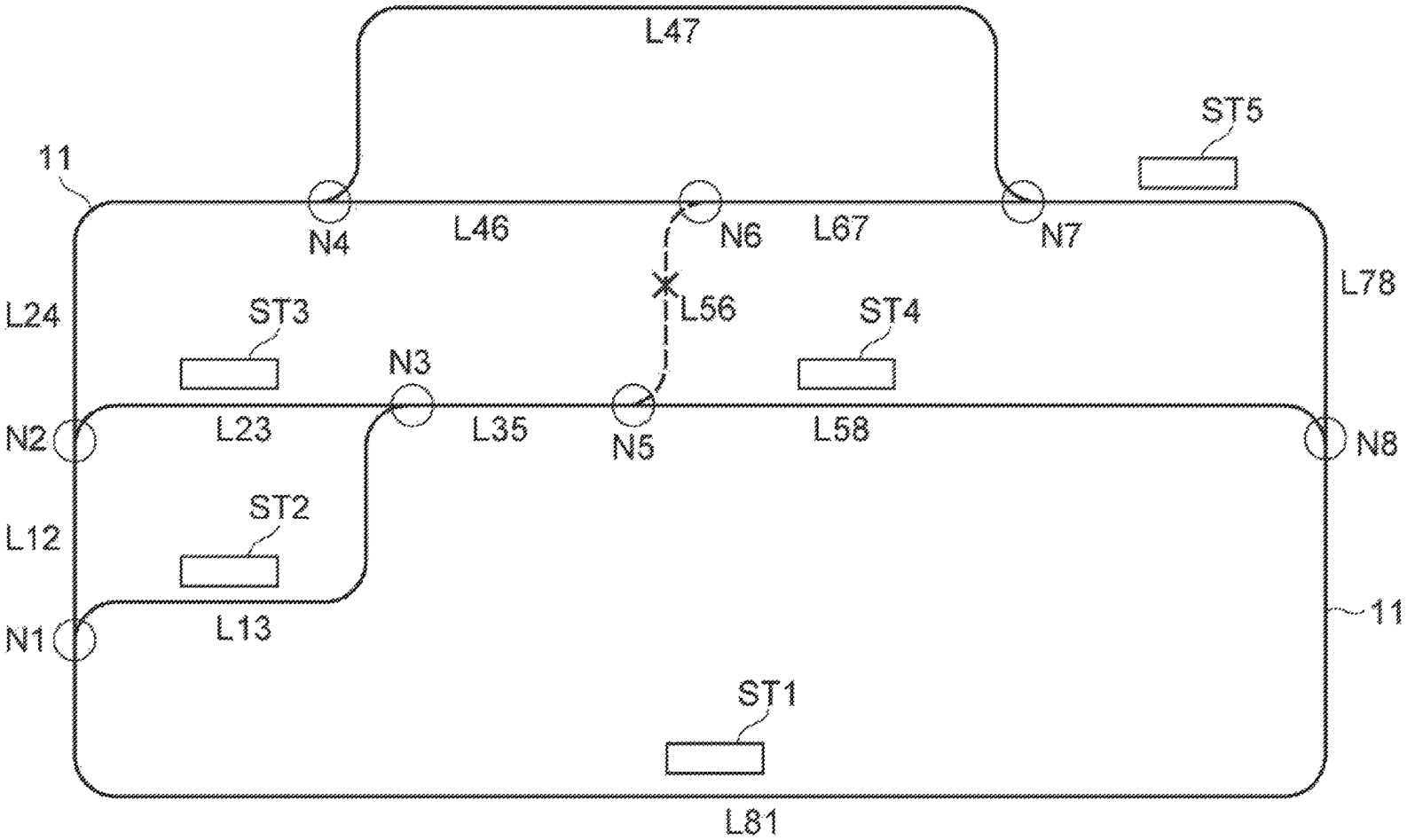
FIG. 4 is an explanatory diagram for describing an additional setting method of a prohibited travel zone according to a preferred embodiment of the present invention.

Rule 2 is specifically described with reference to FIG. 4. For example, as shown in FIG. 4, the zone L56 has been set as a prohibited travel zone by the prohibited travel zone setter 45. At this time, a node point adjacent to the upstream side of the zone L56 which has been set as a prohibited travel zone by the prohibited travel zone setter 45 is the branch point N5. In this case, whether or not all zones on the downstream side that branch off from the branch point N5 (zones L56 and L58) are prohibited travel zones is confirmed.

If all zones branching off from the branch point N5 (zones L56 and L58) are prohibited travel zones, Rule 2 is applied, and the zone L35 on the upstream side adjacent to the branch point N5 is additionally set as a prohibited travel zone. In a case shown in FIG. 4, the other zone branching off from the branch point (the zone L58) is not a prohibited travel zone. Thus, Rule 2 is not applied, and a prohibited travel zone is not additionally set by the additional prohibited travel zone setter 47.

Figure 5:
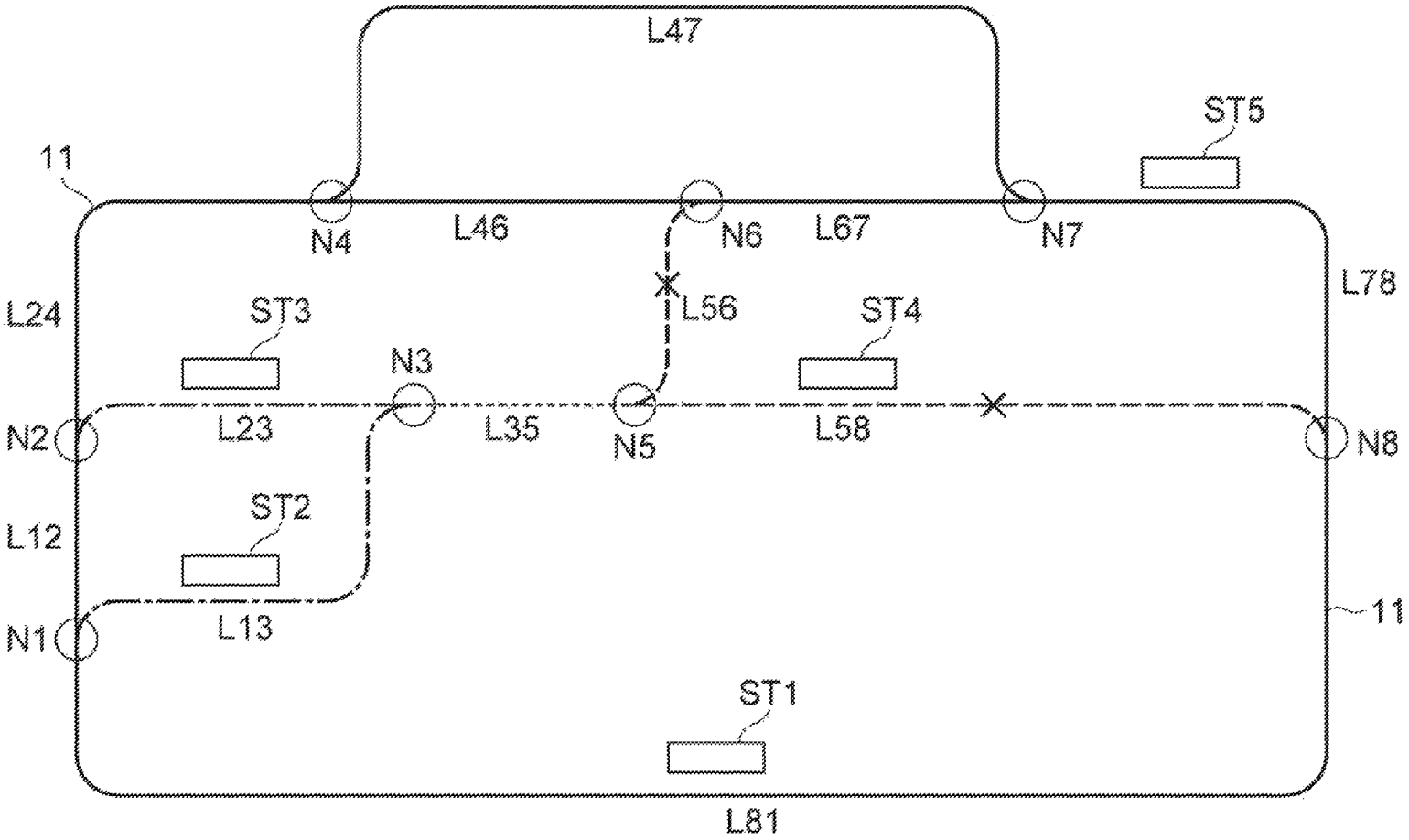
FIG. 5 is an explanatory diagram for describing an additional setting method of a prohibited travel zone according to a preferred embodiment of the present invention.

On the other hand, as shown in FIG. 5, for example, if the zone L58 has been set as a prohibited travel zone before setting the zone L56 as a prohibited travel zone by the prohibited travel zone setter 45, both zones branching off from the branch point (zones L56 and L58) become prohibited travel zones. Thus, Rule 2 is applied, and the zone L35 on the upstream side adjacent to the branch point N5 is additionally set as a prohibited travel zone.

Next, the additional prohibited travel zone setter 47 also additionally sets a prohibited travel zone according to Rules 1 and 2 for the track 11 located on the upstream side of the zone that has been additionally set as a prohibited travel zone by the additional prohibited travel zone setter 47. As shown in FIG. 5, the zone L35 is, as mentioned above, a zone that has been additionally set as a prohibited travel zone by the additional prohibited travel zone setter 47. At this time, a node point adjacent to the upstream side of the zone L35 that has been set as a prohibited travel zone by the prohibited travel zone setter 45 is the merge point N3. Thus, Rule 1 is applied, and all of the zones that merge into the merge point N3 (zones L13 and L23) are additionally set as prohibited travel zones.

The transporting vehicle controller 49 controls the overhead travelling vehicle 5 to prevent the vehicle 5 from entering the prohibited travel zone that has been set by the prohibited travel zone setter 45 or the additional prohibited travel zone setter 47 (Step of controlling a transporting vehicle). Specifically, for example, if a prohibited travel zone is set on one of the zones branching off from a branch point, the transporting vehicle controller 49 does not authorize the entry of the overhead travelling vehicle 5 into the prohibited travel zone even if the target station is located in the prohibited travel zone. The transporting vehicle controller 49 controls the overhead travelling vehicle 5 so as to travel to another zone that is not a prohibited travel zone.

Additionally, if the transporting vehicle controller 49 authorizes one of the overhead travelling vehicles 5 to enter one of the node points, it controls other overhead travelling vehicles 5 so as not to enter the node point (Blocking control). Blocking control is hereinafter described in detail.

The transporting vehicle controller 49 stores one of the node points in association with an ID of an overhead travelling vehicle 5 which has been authorized to travel through the node point. Data where an ID of an overhead travelling vehicle 5 is associated with a node point is sometimes hereinafter referred to as blocking data. There are a plurality of node points that include branch points and merge points on the travelling route of the overhead travelling vehicle 5, so that blocking data is stored for each node point.

If the vehicle body controller 53 in one of the overhead travelling vehicles 5 requests the authorized entry into one of the node points, the transporting vehicle controller 49 refers to the blocking data and confirms whether or not the authorized entry into the aforementioned node point is not given to other overhead travelling vehicles 5. If there is no information on other overhead travelling vehicles 5 that are associated with the aforementioned node point in the blocking data, the transporting vehicle controller 49 provides entry authorization into the node point for the vehicle body controller 53 in the overhead travelling vehicle 5 and also updates the blocking information. If the overhead travelling vehicle 5, that has been authorized to enter the node point, passes through the aforementioned node point, the transporting vehicle controller 49 deletes the blocking information for the aforementioned node point.

Figure 6:
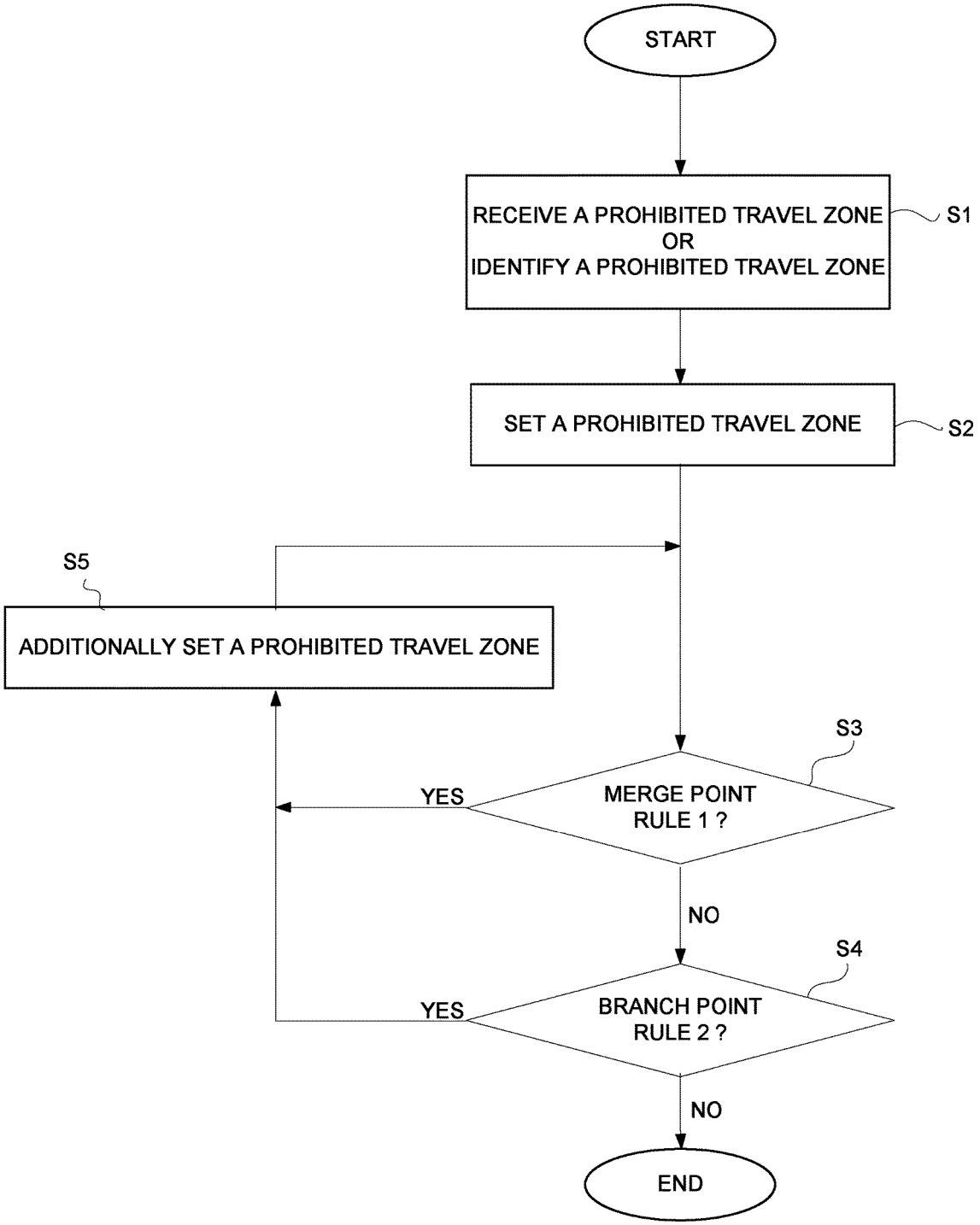
FIG. 6 is a flowchart showing a setting method of a prohibited travel zone.

Next, setting control of a prohibited travel zone in the system controller 3 is described hereinafter with reference to FIG. 6. The receiver 41 receives information on a zone which is preferably set as a prohibited travel zone, or the fault determiner 43 determines a fault in the overhead travelling vehicle 5 and also identifies the position of the overhead travelling vehicle 5 where a fault has occurred, thus starting the setting control (Step S1).

Specifically, the receiver 41 receives information which can identify a zone such as an ID of the zone that a user has inputted into the input interface 31. In addition, when one of the overhead travelling vehicles 5, which has been authorized by the transporting vehicle controller 49 to enter one of the node points does not reach the node point within the prescribed time, the fault determiner 43 determines that a fault has occurred in the overhead travelling vehicle 5.

Next, the prohibited travel zone setter 45 sets a zone, which the receiver 41 has received, or a zone, which the fault determiner 43 has identified, as a prohibited travel zone (Step S2: Step of setting a prohibited travel zone). The transporting vehicle controller 49 controls the vehicle body controller 53 to prevent the overhead travelling vehicle 5 from entering the zone set as a prohibited travel zone.

Next, the additional prohibited travel zone setter 47 extracts a zone to be a prohibited travel zone according to the prescribed rules (preferably Rules 1 and 2 described above) from the track 11 that is located on the upstream side of the zone set as a prohibited travel zone by the prohibited travel zone setter 45, and additionally sets the extracted zone as a prohibited travel zone (refer to the description above for Rules 1 and 2). First, the additional prohibited travel zone setter 47 considers whether or not Rule 1 can be applied (Step S3). Specifically, it determines whether or not a node point adjacent to the upstream side of the prohibited travel zone set by the prohibited travel zone setter 45 is a merge point.

Here, if the additional prohibited travel zone setter 47 has determined that the aforementioned node point is a merge point (S3: YES), the additional prohibited travel zone setter 47 additionally sets all of the zones that merge into the merge point as prohibited travel zones (Step S5). On the other hand, if the additional prohibited travel zone setter 47 has determined that the aforementioned node point is not a merge point (S3: NO), the additional prohibited travel zone setter 47 considers whether or not Rule 2 is applicable (Step S4). Specifically, it determines whether or not a node point adjacent to the upstream side of the prohibited travel zone set by the prohibited travel zone setter 45 is a branch point.

Here, the additional prohibited travel zone setter 47 has determined that the aforementioned node point is a branch point and also all of the zones branching off from the branch point are prohibited travel zones (S4: YES), the additional prohibited travel zone setter 47 additionally sets a zone on the upstream side adjacent to the branch point as a prohibited travel zone (Step S5: Step of additionally setting a prohibited travel zone). On the other hand, if the additional prohibited travel zone setter 47 has determined that the aforementioned node point is a branch point and all of the zones branching off from the branch point are not prohibited travel zones (S4: NO), the additional prohibited travel zone setter 47 terminates a series of processes without additionally setting a new zone as a prohibited travel zone.

Additional setting of a prohibited travel zone by the additional prohibited travel zone setter 47 in Steps S3 and S4 is performed in a similar method for the zone additionally set by the additional prohibited travel zone setter 47 in Step S5. That is, regardless of whether a prohibited travel zone is set initially or additionally, if a new zone is set as a prohibited travel zone, whether or not there is a zone to be added as a prohibited travel zone for the newly set prohibited travel zone is determined.

According to the transporting vehicle system 1 of the present preferred embodiment, a zone, where the overhead travel vehicle 5 with a fault having occurred stops, or a zone, where a user has arbitrarily inputted, is not only set as a prohibited travel zone, but also a prohibited travel zone is automatically additionally set according to Rules 1 and 2. The overhead travelling vehicle 5 is controlled so as not to enter the prohibited travel zone additionally set according to Rules 1 and 2, so that a situation where there is only a prohibited travel zone located on the downstream side in the travel direction of the overhead travelling vehicle 5, that is, a situation where the overhead travelling vehicle 5 gets caught in a dead end, in which it has nowhere to go resulting in being unable to travel, is avoided. As a result, the number of overhead travelling vehicles 5 that become unable to travel is significantly reduced. That is, it is possible to prevent the decline in transporting efficiency of the entire transporting vehicle system 1 arising from the increased number of overhead travelling vehicles 5 that become unable to travel.

In the transporting vehicle system 1 of the present preferred embodiment, if the transporting vehicle controller 49 authorizes the overhead travelling vehicle 5, which requests authorized entry to a node point, to enter the aforementioned node point, it performs blocking control where the authorized entry into the node point is not provided to other overhead travelling vehicles 5. This prevents two or more overhead travelling vehicles 5 from colliding with each other at the node point.

In the transporting vehicle system 1 of the present preferred embodiment, if the overhead travelling vehicles 5, which has been authorized by the transporting vehicle controller 49 to enter the node points, does not reach the node point within the prescribed time, the fault determiner 43 determines that a fault has occurred in the overhead travelling vehicle 5. According to the transporting vehicle system 1 with such a configuration, a fault in the overhead travelling vehicle 5 is able to be detected with a simple configuration without newly installing a detection unit such as a sensor to detect a fault in the overhead travelling vehicle 5

In the transporting vehicle system 1 of the present preferred embodiment, the track 11 includes a first route including the first zone L47, which branches off at the first branch point N4 from a main route including zones L12, L24, L46, L67, L78 and L81. The main route includes the first merge point N6 that is a merge point with a second route including the second zone L56 on the downstream side of the first branch point N4, and the first zone merges into the main route at the second merge point N7 on the downstream side of the first merge point. According to the transporting vehicle system 1 with such a configuration, even if one of the overhead travelling vehicles 5 has been authorized to enter the first merge point N6 and a fault has occurred in the aforementioned overhead travelling vehicle 5, other overhead travelling vehicles 5 divert past the first merge point N6 (via the first zone L47) and return the main route again from the second merge point N7. Thus, if a destination is located farther on the downstream side than the second merge point N7 (for example, the station ST 5), an object to be transported is able to be transported without changing the destination.

Although one preferred embodiment of the present invention has been described above, the present invention is not limited to the aforementioned preferred embodiment, and various modifications can be made in a range not deviating from the gist of the present invention.

First Alternative Preferred Embodiment

In the transporting vehicle system 1 of the aforementioned preferred embodiment, the description has been made by giving the non-limiting example where a zone which is to be a prohibited travel zone is additionally set according to Rules 1 and 2, however the present invention is not limited to this. For example, in addition to a configuration in which the additional prohibited travel zone setter 47 additionally sets a prohibited travel zone according to Rules 1 and 2, a transporting vehicle system 101 may have a configuration in which when the fault determiner 43 detects a fault in the overhead travelling vehicle 5 that has been authorized by the transporting vehicle controller 49 to enter a node point, the additional prohibited travel zone setter 47 also additionally sets a zone, which is adjacent to the node point where the entry has been authorized, as a prohibited travel zone.

Figure 7:
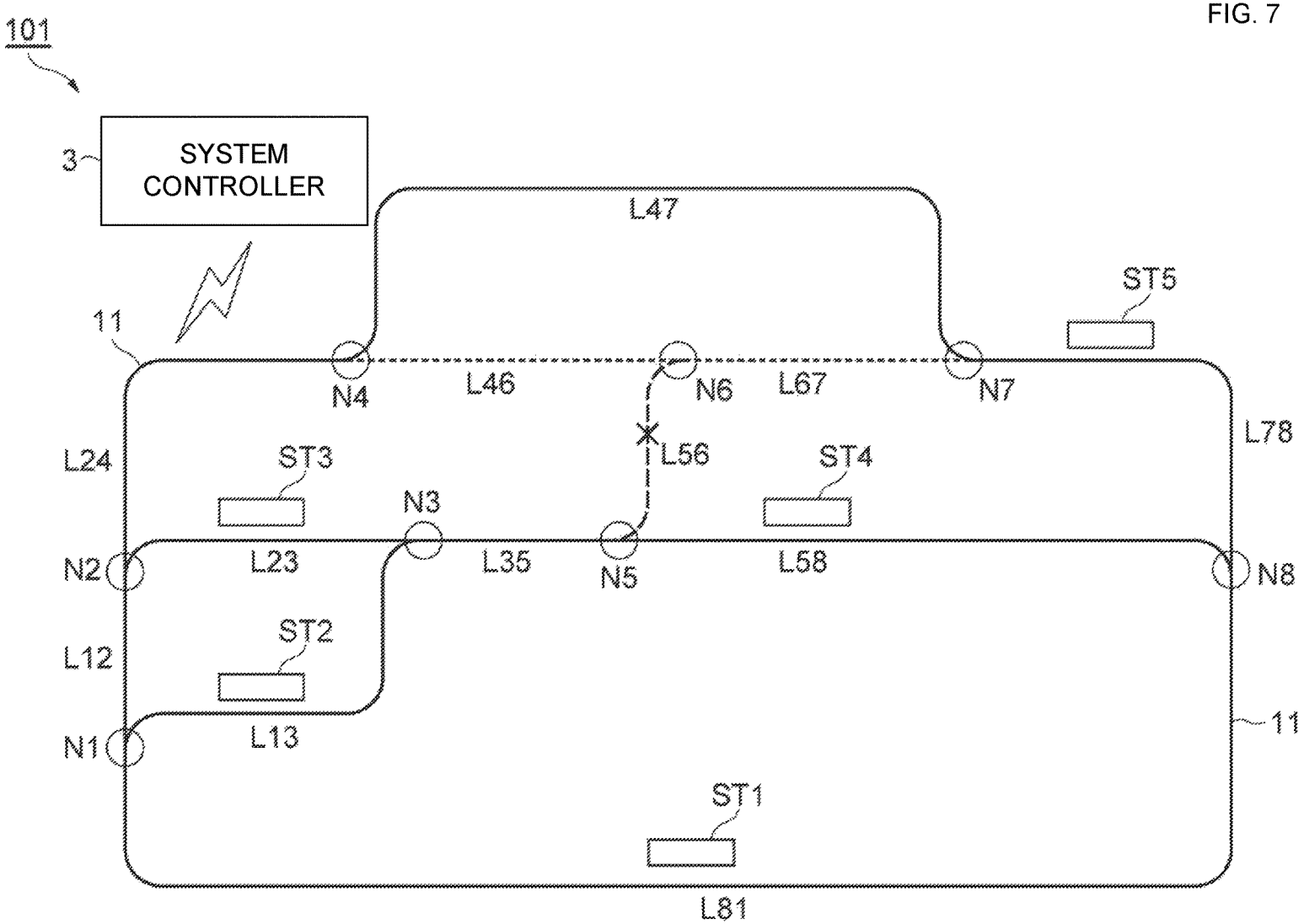
FIG. 7 is an explanatory diagram for describing an additional setting method of a prohibited travel zone according to an alternative preferred embodiment of the present invention.

A specific description will be made with reference to FIG. 7 by giving the example in which a subsequent one of the overhead travelling vehicles 5 travelling on the zone L56 has requested the transporting vehicle controller 49 for authorization to enter the merge point N6, a fault has occurred on the zone L56. If the transporting vehicle controller 49 confirms that there is no blocking data registered for the merge point N6, it authorizes the overhead travelling vehicle 5 to enter the merge point N6. Subsequently, the transporting vehicle controller 49 registers blocking data for the merge point N6.

In this state, if the fault determiner 43 detects a fault in the overhead travelling vehicle 5, which has been authorized by the transporting vehicle controller 49 to enter the merge point N6, the additional prohibited travel zone setter 47 additionally sets zones L46 and L67, which are adjacent to the merge point N6 where the entry was authorized, as prohibited travel zones.

Here, if a fault occurs in the overhead travelling vehicle 5 while having obtained authorization to enter the merge point N6, other overhead travelling vehicles 5 are not authorized to enter the merge point N6. This is because that blocking data has been registered for the merge point N6. According to the transporting vehicle system 101 of this preferred embodiment, the zone L46 is also additionally set as a prohibited travel zone, so that it is possible to prevent a situation where other overhead travelling vehicles 5 enter the zone L46, but are unable to enter the merge point N6 resulting in getting caught in a dead end. That is, as shown in the aforementioned preferred embodiment, it is possible to prevent subsequent overhead travelling vehicles 5 from getting caught in a so-called dead end, not only in a situation, where the overhead travelling vehicle 5 in which a fault has occurred blocks the track resulting in the subsequent overhead travelling vehicles 5 being physically unable to travel through, but also in a situation, where the subsequent overhead travelling vehicles 5 are physically able to travel, but are controlled so as not to travel through as described in the aforementioned blocking control.

Figure 8:
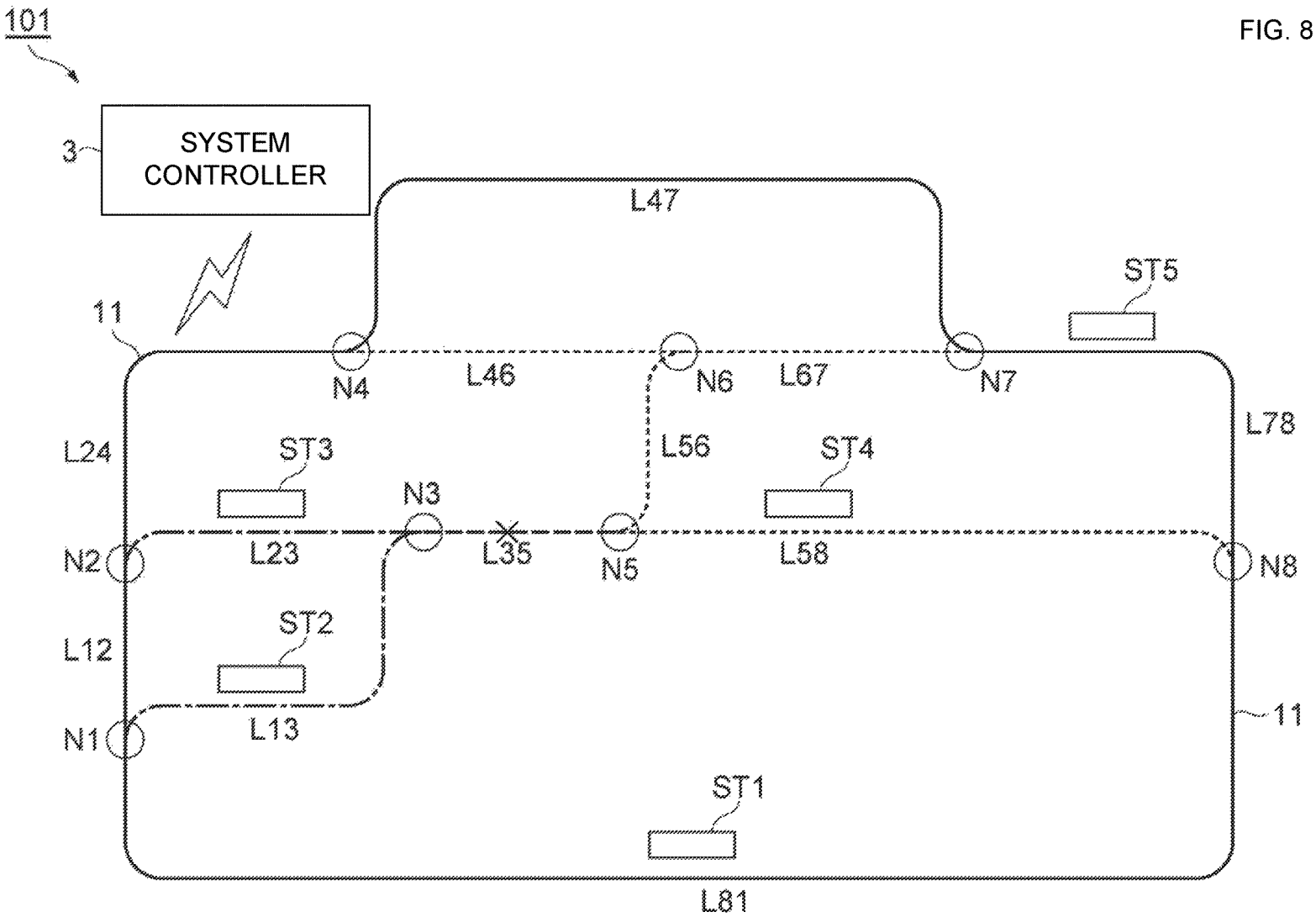
FIG. 8 is an explanatory diagram for describing an additional setting method of a prohibited travel zone according to an alternative preferred embodiment of the present invention.

Next, a concrete description will be made with reference to FIG. 8 by giving the example where subsequent to one of the overhead travelling vehicles 5 travelling on the zone L35 has requested the transporting vehicle controller 49 for authorization to enter the branch point N5 and the merge point N6, a fault has occurred on the zone L35. If the transporting vehicle controller 49 confirms that there is no blocking data registered for the branch point N5 and the merge point N6, it authorizes the overhead travelling vehicle 5 to enter the branch point N5 and the merge point N6. Subsequently, the transporting vehicle controller 49 registers blocking data for the branch point N5 and the merge point N6.

In this state, if the fault determiner 43 detects a fault in the overhead travelling vehicle 5, which has been authorized by the transporting vehicle controller 49 to enter the branch point N5 and the merge point N6, the prohibited travel zone setter 45 sets the zone L35 as a prohibited travel zone based on position information that is sent by the overhead travelling vehicle 5 determined by the fault determiner 43. Next, the additional prohibited travel zone setter 47 additionally sets the zones L13 and L23 as prohibited travel zones according to Rule 1 from the track 11 located on the upstream side of the zone L35. Furthermore, the additional prohibited travel zone setter 47 additionally sets the zones L58 and L56, which are adjacent to the branch point N5 where the entry has been authorized, and the zones L46 and L67, which are adjacent to the merge point N6, as prohibited travel zones.

Here, if a fault occurs in the overhead travelling vehicle 5 while having obtained authorization to enter the branch point N5 and the merge point N6, other overhead travelling vehicles 5 are not authorized to enter the branch point N5 and the merge point N6. This is because that blocking data has been registered for the branch point N5 and the merge point N6. According to the transporting vehicle system 101 of this preferred embodiment, the zone 35, where the overhead traveling vehicle 5 with a fault having occurred stops, is not only set as a prohibited travel zone, but also the zones L13 and L23 are automatically additionally set as prohibited travel zones according to the aforementioned Rule 1. Thus, a situation where there is only a prohibited travel zone located on the downstream side in the travel direction of the overhead travelling vehicle 5, that is, a situation where the overhead travelling vehicle 5 gets caught in a dead end, in which it has nowhere to go resulting in being unable to travel, is able to be avoided. According to the transporting vehicle system 101 of this preferred embodiment, the zone L46 is also additionally set as a prohibited travel zone, so that it is possible to prevent a situation where other overhead travelling vehicles 5 enter the zone L46, but are unable to enter the merge point N6 resulting in getting caught in a dead end. That is, it is possible to prevent subsequent overhead travelling vehicles 5 from getting caught in a so-called dead end, not only in a situation where the overhead travelling vehicle 5 in which a fault has occurred blocks the track resulting in the subsequent overhead travelling vehicles 5 being physically unable to travel through, but also in a situation where the subsequent overhead travelling vehicles 5 are physically able to travel, but are controlled so as not to travel through as described in the aforementioned blocking control.

Additionally, in the transporting vehicle system. 101 of the aforementioned alternative preferred embodiment, the description has been made by giving the example of a method where block data is set for each node point, however blocking data may be set for each zone, for example. In this case, the transporting vehicle controller 49 stores both node points, which include a node point on the entrance side of a zone and a node point on the exit side of the zone, in association with an ID of the overhead travelling vehicle 5 to which travel authorization has been provided. For example, as shown in FIG. 7, if the transporting vehicle controller 49 authorizes the overhead travelling vehicle 5 to enter from the zone L35 to the zone L56, the transporting vehicle controller 49 stores the branch point N5, which is on the entrance side of the zone L35, and the merge point N6, which is on the exit side of the zone L56, in association with an ID of the overhead travelling vehicle 5, to which travel authorization has been provided.

Even if such a blocking control is performed, as is the case with the transporting vehicle system 101 according to the aforementioned alternative preferred embodiments, the additional prohibited travel zone setter 47 is also able to additionally set a zone adjacent to the node point, where the entry has been authorized, as a prohibited travel zone, thus being able to obtain effects similar to the transporting vehicle system 101 according to the aforementioned alternative preferred embodiments.

Other Alternative Preferred Embodiments

In the transporting vehicle systems 1, 101 of the aforementioned preferred embodiments and alternative preferred embodiments, the description has been made by describing the overhead travelling vehicle 5 as one example of the transporting vehicle, however other examples of the transporting vehicle include an unmanned transporting vehicle and a stacker crane which travel on a track installed on the ground or a frame, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A transporting vehicle system comprising:

a plurality of transporting vehicles that travel along a route including node points that include branch points where the route branches off and merge points where the route merges into, and zones located between the node points; and a controller; wherein the controller is configured or programmed to set a first prohibited travel zone that is one of the zones where entry of the transporting vehicles is prohibited;

the controller is configured or programmed to set a second prohibited travel zone upstream of the first prohibited travel zone;

the controller is configured or programmed to control the transporting vehicles to prevent the transporting vehicles from entering the first prohibited travel zone or the second prohibited travel zone;

if one of the node points upstream of the first prohibited travel zone is one of the merge points, the controller is configured or programmed to set all of the zones that merge into the one of the merge points as additional prohibited travel zones; and if one of the node points upstream of the first prohibited travel zone is one of the branch points and all of the zones branching off from the one of the branch points are the additional prohibited travel zones, the controller is configured or programmed to set one of the zones upstream of the one of the branch points as one of the additional prohibited travel zones.

2. The transporting vehicle system according to claim 1, wherein each of the transporting vehicles includes:

a vehicle body controller that requests authorization for the transporting vehicle to enter one of the node points when the transporting vehicle reaches a front of the one of the node points; wherein if the controller authorizes one of the plurality of transporting vehicles, which requests authorized entry into the one of the node points, to enter the one of the node points, the controller is configured or programmed to control others of the plurality of transporting vehicles to prevent the others of the plurality of transporting vehicle from entering the one of the node points.

3. The transporting vehicle system according to claim 2, wherein the controller is configured or programmed to determine a fault has occurred when the one of the plurality of transporting vehicles authorized by the controller to enter the one of the node points does not reach the one of the node points within a predetermined time.

4. The transporting vehicle system according to claim 3, wherein if the controller determines a fault in the one of the plurality of transporting vehicles authorized by the controller to enter the one of the node points, the controller is configured or programmed to set one of the zones adjacent to the one of the node points as one of the additional prohibited travel zones.

5. The transporting vehicle system according to claim 2, wherein the route includes:

a main route; and a first route; wherein the first route branches off from the main route at one of the branch points;

the main route includes a first one of the merge points that merges with a second route downstream of the one of the branch points; and the first route merges into the main route at a second one of the merge points downstream of the first one of the merge points.

* * * * *